US007883179B2

(12) United States Patent
Cha et al.

(10) Patent No.: US 7,883,179 B2
(45) Date of Patent: Feb. 8, 2011

(54) NOZZLE PLATE USABLE WITH INKJET PRINTHEAD

(75) Inventors: Tae-woon Cha, Yongin-si (KR); Jae-woo Chung, Yongin-si (KR)

(73) Assignee: Samsung Electronics Co. Ltd, Suwon-si (KR)

( * ) Notice: Subject to any disclaimer, the term of this patent is extended or adjusted under 35 U.S.C. 154(b) by 904 days.

(21) Appl. No.: 11/755,975

(22) Filed: May 31, 2007

(65) Prior Publication Data

US 2008/0158297 A1 Jul. 3, 2008

(30) Foreign Application Priority Data

Dec. 27, 2006 (KR) ..... 10-2006-0135546

(51) Int. Cl.
*B41J 2/135* (2006.01)

(52) U.S. Cl. ..... 347/45; 347/20; 347/44; 347/47

(58) Field of Classification Search ..... 347/20, 347/44, 45, 47
See application file for complete search history.

(56) References Cited

U.S. PATENT DOCUMENTS

| | | | | |
|---|---|---|---|---|
| 6,743,516 | B2 | 6/2004 | Murphy et al. | |
| 7,434,913 | B2 * | 10/2008 | Suzuki et al. | 347/45 |
| 7,441,871 | B2 * | 10/2008 | Nishijima | 347/47 |
| 2005/0190231 | A1 * | 9/2005 | Lim et al. | 347/45 |

* cited by examiner

*Primary Examiner*—Ryan Lepisto
(74) *Attorney, Agent, or Firm*—Stanzione & Kim LLP

(57) ABSTRACT

A nozzle plate usable with an inkjet printhead includes a substrate through which a plurality of nozzles are formed, an ink-philic material layer formed on an outer surface of the substrate and inner walls of the nozzles, and a plurality of nonwetting coating layers sequentially formed on the ink-philic material layer formed on the outer surface of the substrate, each nonwetting coating layer including an adhesive layer and an ink-phobic material layer deposited on the adhesive layer.

19 Claims, 8 Drawing Sheets

NOZZLE PLATE USABLE WITH INKJET PRINTHEAD

CROSS-REFERENCE TO RELATED APPLICATIONS

This application claims the benefit of Korean Patent Application No. 10-2006-0135546, filed on Dec. 27, 2006, in the Korean Intellectual Property Office, the disclosure of which is incorporated herein in its entirety by reference.

BACKGROUND OF THE INVENTION

1. Field of the Invention

The present general inventive concept relates to a nozzle plate usable with an inkjet printhead, and more particularly, to a nozzle plate usable with an inkjet printhead, which includes a nonwetting coating layer having high durability.

2. Description of the Related Art

An inkjet printhead is an apparatus that ejects very small droplets of printing ink on a printing medium in a desired position to print an image in a predetermined color. Inkjet printheads may be largely classified into thermal inkjet printheads and piezoelectric inkjet printheads. The thermal inkjet printhead produces bubbles using a thermal source and ejects ink due to the expansive force of the bubbles. The piezoelectric inkjet printhead applies pressure generated by deforming a piezoelectric material to ink and ejects the ink due to the generated pressure.

FIG. 1 is a schematic cross-sectional view of a conventional piezoelectric inkjet printhead as an example of a conventional inject printhread.

Referring to FIG. 1, a manifold 11, a plurality of restrictors 12, and a plurality of pressure chambers 13 are formed in a flow path plate 10 and constitute an ink flow path. A vibrating plate 20 is adhered to a top surface of the flow path plate 10. The vibrating plate 20 is deformed due to the drive of a piezoelectric actuator 40. A nozzle plate 30 having a plurality of nozzles 31 is adhered to a bottom surface of the flow path plate 10. Meanwhile, the flow path plate 10 may be integrally formed with the vibrating plate 20. Also, the flow path plate 10 may be integrally formed with the nozzle plate 30.

The manifold 11 is a path through which ink is supplied from an ink storage (not shown) to the respective pressure chambers 13. The restrictors 12 are paths through which ink is supplied from the manifold 11 to the respective pressure chambers 13. The pressure chambers 13 are arranged on one side or both sides of the manifold 11 and are filled with ink to be ejected. The nozzles 31 are formed through the nozzle plate 30 to communicate with the pressure chambers 13. The vibrating plate 20 is adhered to the top surface of the flow path plate 10 to cover the pressure chamber 13. The vibrating plate 20 is deformed due to the drive of the piezoelectric actuator 40 and provides a pressure variation required for ejecting ink to the respective pressure chambers 13. The piezoelectric actuator 40 includes a lower electrode 41, a piezoelectric layer 42, and an upper electrode 43 that are sequentially stacked on the vibrating plate 20. The lower electrode 41 is disposed on the entire surface of the vibrating plate 20 and functions as a common electrode. The piezoelectric layer 42 is disposed on the lower electrode 42 over the respective pressure chambers 13. The upper electrode 43 is disposed on the piezoelectric layer 42 and functions as a drive electrode for applying a voltage to the piezoelectric layer 42.

In the inkjet printhead having the above-described construction, the surface treatment of the nozzle plate 30 directly affects the ink ejecting performance of the inkjet printhead, for example, the straightness and ejection rate of droplets of ink ejected via the nozzles 31. That is, in order to improve the ink ejecting performance of the inkjet printhead, an inner wall of the nozzle 31 must be ink-philic, while the surface of the nozzle plate 30 outside the nozzle 31 must be ink-phobic. Specifically, when the inner wall of the nozzle 31 is ink-philic, the inner wall of the nozzle 31 makes a small contact angle with ink, so that the capillary force of the nozzle 31 increases. Thus, a time taken to refill ink can be shortened to increase the spray frequency of the nozzle 31. Also, when the surface of the nozzle plate 20 outside the nozzle 22 is ink-phobic, the surface of the nozzle plate 20 can be prevented from being wet with ink so that the straightness of ejected ink can be ensured. Thus, a coating layer formed of an ink-phobic material is formed on the surface of the nozzle plate 30 outside the nozzle 31. Perfluorinated silane is widely used as the ink-phobic material because it is known that perfluorinated silane lowers the surface energy of the nozzle plate 30 to minimize ink-wetting.

Meanwhile, an ink-phobic coating layer formed on the surface of the nozzle plate 30 should satisfy the two following requirements. First, the ink-phobic coating layer must make a large contact angle with ink. Second, after ejecting ink, the contact angle of the ink-phobic coating layer with the ink must be maintained constant in time. In other words, the ink-phobic coating layer should have high durability.

FIG. 2 is a cross-sectional view of a conventional nozzle plate for an inkjet print head, and FIG. 3 is a magnified view of region "A" shown in FIG. 2.

Referring to FIGS. 2 and 3, a nozzle plate 30 includes a silicon substrate 32 through which a nozzle 31 is formed, a thermally oxidized silicon layer 34 formed on the surface of the silicon substrate 32, and an ink-phobic coating layer 38 deposited on the thermally oxidized silicon layer 34. The thermally oxidized silicon layer 34 is formed on the entire surface of the silicon substrate 32 including an inner wall of the nozzle 31. Also, the ink-phobic coating layer 38 is formed on the thermally oxidized silicon layer 34 formed on the silicon substrate 32 outside the nozzle 31. The ink-phobic coating layer 38 is formed of perfluorinated silane. In the nozzle plate 30 having the above-described construction, since the adhesion of the ink-phobic coating layer 38 formed of perfluorinated silane to the thermally oxidized silicon layer 34 is weak, the durability of the ink-phobic coating layer 38 is very likely to deteriorate over time.

SUMMARY OF THE INVENTION

The present general inventive concept provides a nozzle plate usable with an inkjet printhead, which includes a nonwetting coating layer having high durability.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing a nozzle plate usable with an inkjet printhead, which includes a substrate through which a plurality of nozzles are formed, an ink-philic material layer disposed on an outer surface of the substrate and inner walls of the nozzles, and a plurality of nonwetting coating layers sequentially disposed on the ink-philic material layer disposed on the outer surface of the substrate, each nonwetting coating layer including an adhesive layer and an ink-phobic material layer deposited on the adhesive layer.

The substrate may be formed of silicon. The ink-philic material layer may be formed of thermally oxidized silicon.

The adhesive layer may be formed of deposited silicon oxide, and the ink-phobic material layer may be formed of perfluorinated silane. In this case, the adhesive layer and the ink-phobic material layer may be formed using a physical vapor deposition (PVD) process.

The foregoing and/or other aspects and utilities of the present general inventive concept may also be achieved by providing a method of forming a nozzle plate usable with an inkjet printhead, the method including forming a plurality of nozzles on a substrate, forming an ink-philic material layer on an outer surface of the substrate and inner walls of the nozzles, and forming a plurality of nonwetting coating layers sequentially on the ink-philic material layer formed on the outer surface of the substrate, each nonwetting coating layer including an adhesive layer and an ink-phobic material layer deposited on the adhesive layer.

The foregoing and/or other aspects and utilities of the present general inventive concept may also be achieved by providing a nozzle plate usable with an inkjet printhead, the nozzle plate including a substrate having a nozzle, an ink-philic material layer formed on an outer surface of the substrate and an inner wall of the nozzle, and a plurality of ink-phobic material layers formed on the ink-philic material layer.

The nozzle plate may further include an adhesive layer formed between the ink-philic material layer and the plurality of ink-phobic material layers.

The adhesive layer may have a first thickness, and each of the plurality of ink-phobic material layers may have a second thickness.

The adhesive layer may have a surface having a first surface roughness, and each of the plurality of ink-phobic material layers may have a second surface having a second surface roughness.

The nozzle plate may further include an adhesive layer formed between the adjacent ink-phobic material layers.

The plurality of ink-phobic material layers may have different surface roughness.

The plurality of ink-phobic material layers may have a same thickness.

The plurality of ink-phobic material layers may include a first ink-phobic material layer having a first thickness and a second ink-phobic material layer having a second thickness.

The plurality of ink-phobic material layers may include a first ink-phobic material layer having a first surface roughness and a second ink-phobic material layer having a second surface roughness.

The foregoing and/or other aspects and utilities of the present general inventive concept may also be achieved by providing an inkjet printhead, including a layer formed with a pressure chamber to contain ink, and a nozzle plate having a substrate through which a nozzle is formed to eject the ink from the pressure chamber, an ink-philic material layer formed on an outer surface of the substrate and an inner wall of the nozzle, and a plurality of nonwetting coating layers sequentially formed on the ink-philic material layer formed on the outer surface of the substrate, each nonwetting coating layer including an adhesive layer and an ink-phobic material layer deposited on the adhesive layer.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
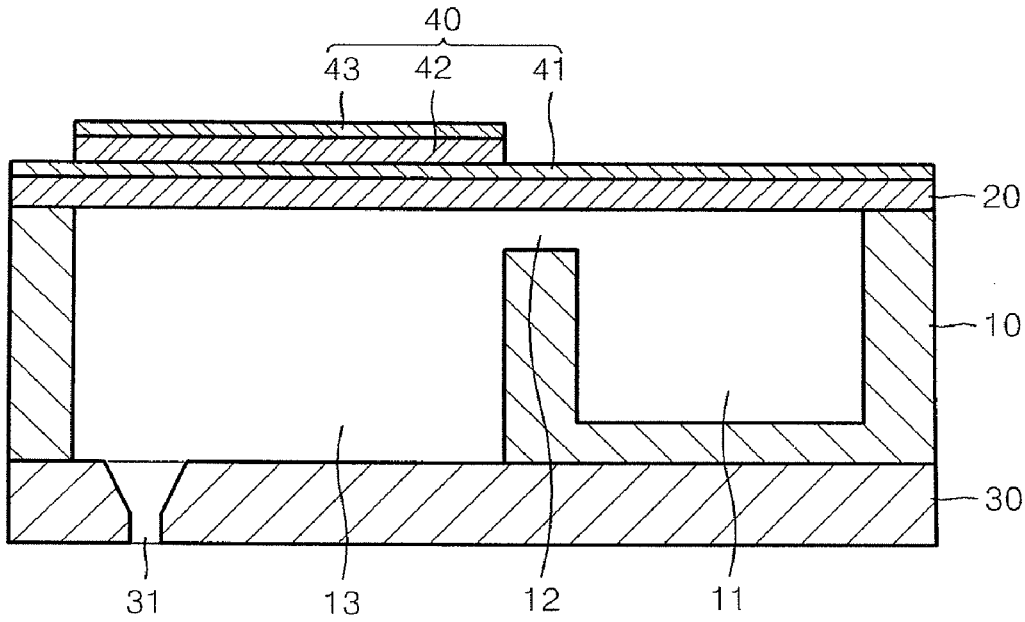
FIG. 1 (PRIOR ART)
FIG. 1 is a cross-sectional view of a conventional piezoelectric inkjet printhead.
Figure 2:
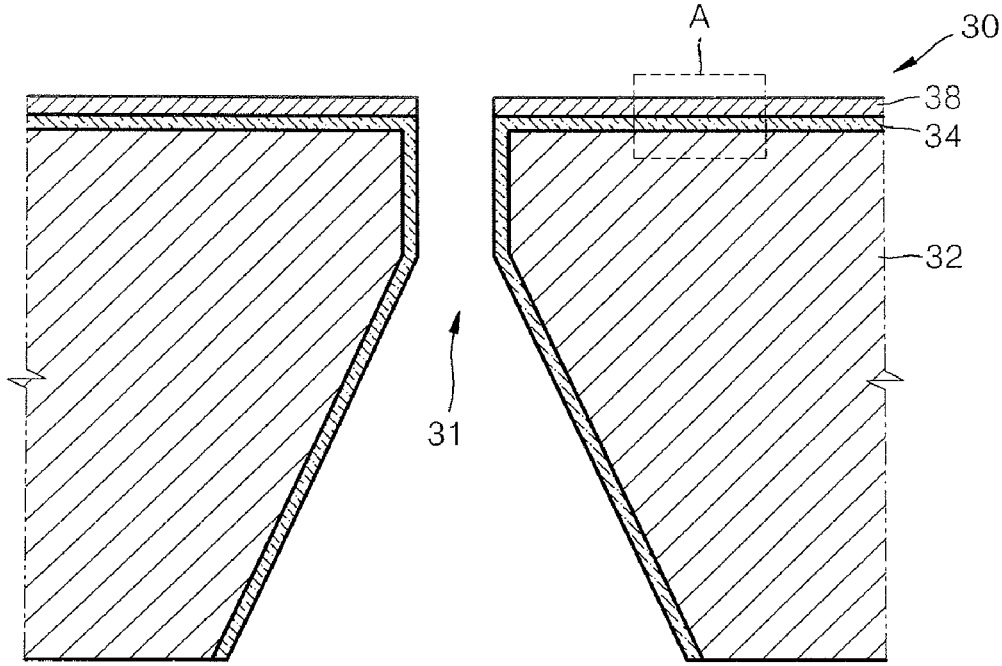
FIG. 2 (PRIOR ART)
FIG. 2 is a cross-sectional view of a conventional nozzle plate usable with an inkjet print head of FIG. 1.
Figure 3:
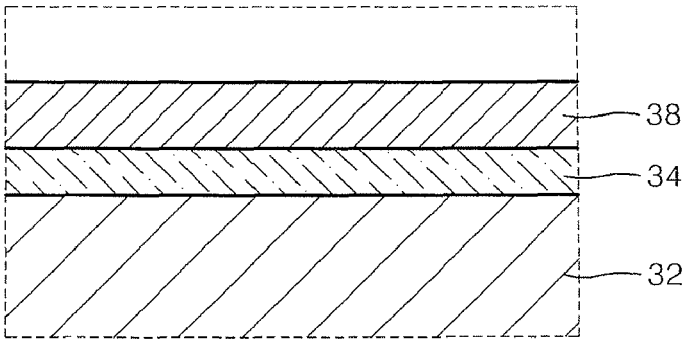
FIG. 3 (PRIOR ART)
FIG. 3 is a magnified view of region "A" shown in FIG. 2.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 4:
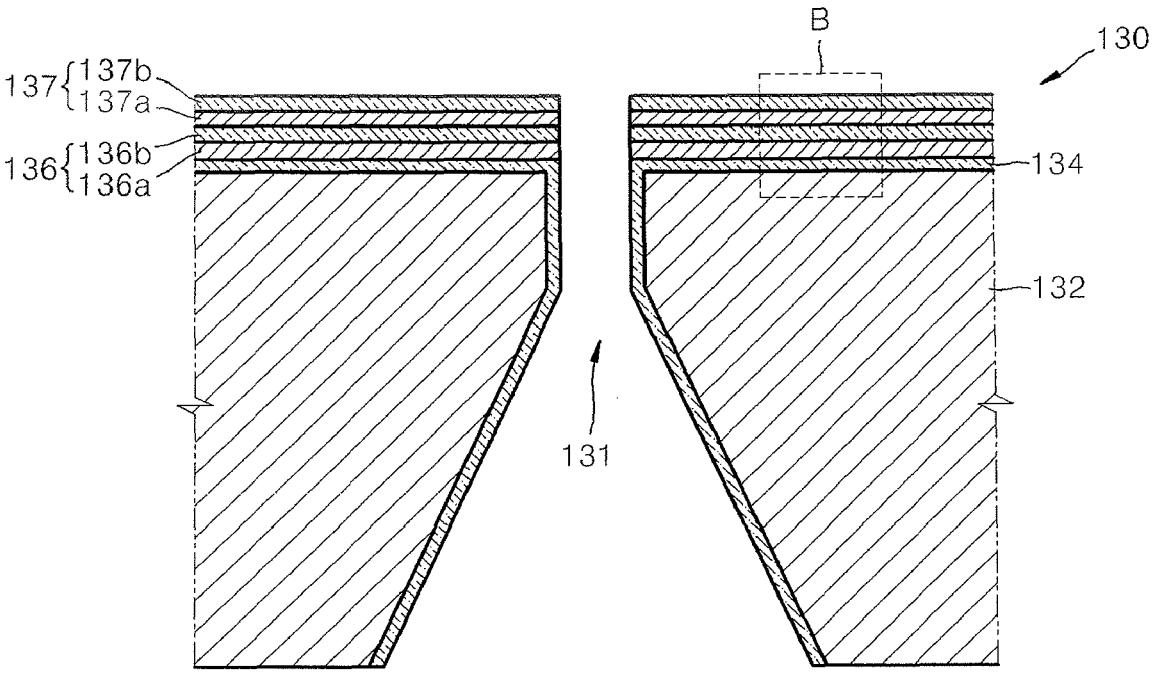
FIG. 4 is a plan view of a nozzle plate usable with an inkjet printhead according to an embodiment of the present general inventive concept.
Figure 5:
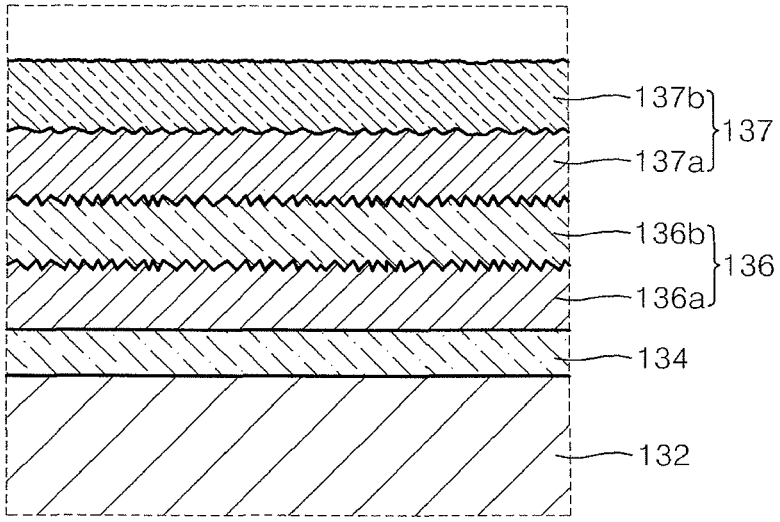
FIG. 5 is a magnified view of portion "B" of FIG. 4.

FIG. 4 is a plan view of a nozzle plate 130 usable with an inkjet printhead according to an embodiment of the present general inventive concept, and FIG. 5 is a magnified view of portion "B" of FIG. 4. The inkjet printhead according to the present general inventive concept may be a similar structure to a conventional inkjet printhead of FIG. 1 except the nozzle plate 130 of FIG. 4.

Referring to FIGS. 4 and 5, the nozzle plate 130 includes a substrate 132 having nozzles 131, an ink-philic material layer 134 disposed on the entire surface of the substrate 132, and first and second nonwetting coating layers 136 and 137 that are sequentially disposed on the ink-philic material layer 134.

The substrate 132 may be a silicon substrate. A plurality of nozzles 131 for ejecting ink are formed through the substrate 132. Also, the ink-philic material layer 134 may be formed on an inner wall of the nozzle 131 and an outer surface of the substrate 132. The ink-philic material layer 134 may be formed of thermally oxidized silicon. In this case, the ink-philic material layer 134 may be obtained by thermally oxidizing the entire surface of the substrate 132 made of silicon.

The first nonwetting coating layer 136 is formed on a top surface of the substrate 132, that is, on the ink-philic material layer 134 formed on the outer surface of the substrate 132 adjacent to an outlet of the nozzle 131. The first nonwetting coating layer 136 includes a first adhesive layer **136*a* and a first ink-phobic material layer 136*b* that are sequentially disposed on the ink-philic material layer 134. The first adhesive layer 136***a* is disposed on a top surface of the ink-philic material layer 134, and the first ink-phobic material layer 136*b* is disposed on the first adhesive layer 136*a*. The first adhesive layer 136*a* may be formed of deposited silicon oxide. The first adhesive layer 136*a* may be obtained by depositing silicon oxide on the top surface of the ink-philic material layer 134 using a physical vapor deposition (PVD) process, for example, an electron beam (e-beam) evaporation process. The resulting first adhesive layer 136*a* may have a relatively high surface roughness. For instance, the surface of the first adhesive layer 136*a* made of deposited silicon oxide may have a root mean square (RMS) roughness of about 0.5 to 2 nm.

Also, the first ink-phobic material layer 136*b* may be formed of perfluorinated silane on a top surface of the first adhesive layer 136*a*. The first ink-phobic material layer 136*b* may be obtained by depositing perfluorinated silane on the top surface of the first adhesive layer 136*a* using a PVD process, for example, an e-beam evaporation process. When the first ink-phobic material layer 136*b* made of perfluorinated silane is deposited on the surface of the first adhesive layer 136*b* with a high surface roughness, a highly packed siloxane network is formed at an interface between the first adhesive layer 136*a* and the first ink-phobic material layer 136*b*, so that the adhesion of the first adhesive layer 136*a* to the first ink-phobic material layer 136*b* can be enhanced. As a result, the durability of the first nonwetting coating layer 136 can be improved.

The surface roughness of outer surfaces of the first adhesive layer 136*a* and the first ink-phobic material layer 136*b* may be different, and roughness of the adjacent surfaces of the first adhesive layer 136*a* and the first ink-phobic material layer 136*b* may be same. That is, the roughness of the outer surface of the first ink-phobic material layer 136*b* may be smaller than the roughness of the outer surface of the first adhesive layer 136*a*.

Thickness of the first adhesive layer 136*a* and the first ink-phobic material layer 136*b* may be different from each other. It is possible that the first adhesive layer 136*a* and the first ink-phobic material layer 136*b* may have the same thickness.

The second nonwetting coating layer 137 is formed on the first nonwetting coating layer 136 that includes the first adhesive layer 136*a* and the first ink-phobic material layer 136*b*. The second nonwetting coating layer 137 includes a second adhesive layer 137*a*, which is formed on a top surface of the first ink-phobic material layer 136*b*, and a second ink-phobic material layer 137*b*, which is formed on a top surface of the second adhesive layer 137*a*.

The second adhesive layer 137*a* may be formed of deposited silicon oxide like the first adhesive layer 136*a*. The second adhesive layer 137*a* may be obtained by depositing silicon oxide on the top surface of the first ink-phobic material layer 136*b* using a PVD process. The resulting second adhesive layer 137*a* has a lower surface roughness than the first adhesive layer 136*a*. Also, the second ink-phobic material layer 137*b* may be formed of perfluorinated silane like the foregoing first ink-phobic material layer 136*b*. The second ink-phobic material layer 137*b* may be obtained by depositing perfluorinated silane on the top surface of the second adhesive layer 137*a* using a PVD process. In this case, a solider highly packed siloxane network without defects can be formed at an interface between the second adhesive layer 137*a* and the second ink-phobic material layer 137*b*, so that the adhesion of the second adhesive layer 137*a* to the second ink-phobic material layer 137*b* can be greatly elevated.

That is, since the first adhesive layer 136*a* formed on the top surface of the ink-philic material layer 134 has a high surface roughness, when the first ink-phobic material layer 136*b* is deposited on the surface of the first adhesive layer 136*a* having a high surface roughness, defects such as pin holes are apt to occur at the interface between the first adhesive layer 136*a* and the first ink-phobic material layer 136*b*. Thus, the second adhesive layer 137*a* is deposited on the top surface of the first ink-phobic material layer 136*b* so that the second adhesive layer 137*a* can have a lower surface roughness than the first adhesive layer 136*a*, specifically, such a low surface roughness as to permit the formation of the solid highly packed siloxane network without defects. Therefore, when the second ink-phobic material layer 137*b* is deposited on the surface of the second adhesive layer 137*a*, the adhesion of the second adhesive layer 137*a* to the second ink-phobic material layer 137*b* can be markedly elevated. As a result, the durability of the second nonwetting coating layer 137 can be improved.

The surface roughness of outer surfaces of the second adhesive layer 137*a* and the second ink-phobic material layer 137*b* may be different, and roughness of the adjacent surfaces of the second adhesive layer 137*a* and the second ink-phobic material layer 137*b* may be same. That is, the roughness of the outer surface of the second ink-phobic material layer 137*b* may be smaller than the roughness of the outer surface of the second adhesive layer 137*a*. It is possible that the surface roughness of the outer surfaces of the second adhesive layer 137*a* and the second ink-phobic material layer 137*b* may be different from the surface roughness of outer surfaces of the first adhesive layer 136*a* and the first ink-phobic material layer 136*b*. It is also possible that the surface roughness of the outer surfaces of the second adhesive layer 137*a* and the second ink-phobic material layer 137*b* may be smaller than the surface roughness of outer surfaces of the first adhesive layer 136*a* and the first ink-phobic material layer 136*b*.

Thickness of the second adhesive layer 137*a* and the second ink-phobic material layer 137*b* may be different from each other. It is possible that the second adhesive layer 137*a* and the second ink-phobic material layer 137*b* may have the same thickness. It is also possible that the first adhesive layer 136*a* and the first ink-phobic material layer 136*b* may have a first thickness, and the second adhesive layer 137*a* and the second ink-phobic material layer 137*b* may have a second thickness.

As described above, the nozzle plate for the inkjet printhead according to the embodiment of the present general inventive concept includes a plurality of nonwetting coating layers, that is, the first and second nonwetting coating layers 136 and 137, which are sequentially formed on the ink-philic material layer 134 disposed on the outer surface of the substrate 132, so that the durability of the nozzle plate can be enhanced.

Figure 6:
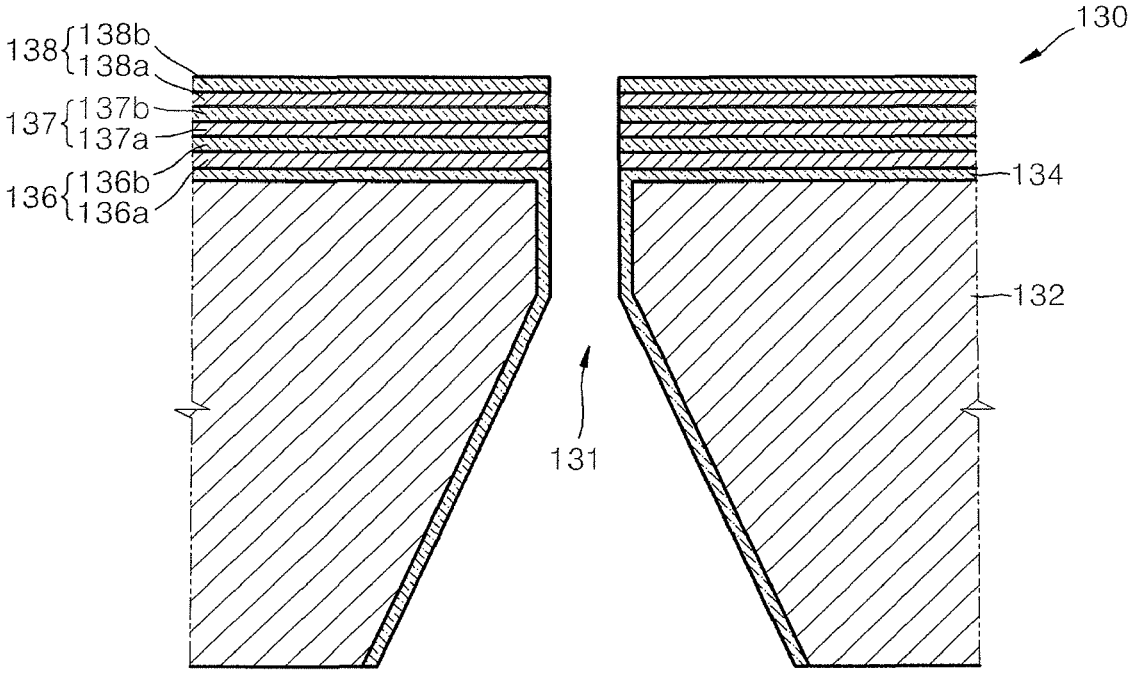
FIG. 6 is a cross-sectional view of a nozzle plate for an inkjet printhead according to another embodiment of the present invention.

FIG. 6 is a cross-sectional view of a nozzle plate 130 usable with an inkjet printhead according to another embodiment of the present general inventive concept. Hereinafter, differences between the previous embodiment and the present embodiment will be chiefly described. In the present embodiment shown in FIG. 6, three nonwetting coating layers 136, 137, and 138 are disposed on a surface of the nozzle plate 130.

Referring to FIG. 6, an ink-philic material layer 134 formed of thermally oxidized silicon is disposed on an inner wall of a nozzle 131 and an outer surface of a substrate 132. Also, a plurality of nonwetting coating layers, i.e., first through third nonwetting coating layers 136, 137, and 138, are sequentially stacked on the ink-philic material layer 134 formed on the outer surface of the substrate 132.

The first nonwetting coating layer 136 includes a first adhesive layer 136*a*, which is formed on a top surface of the ink-philic material layer 134, and a first ink-phobic material layer 136*b*, which is formed on a top surface of the first adhesive layer 136*a*. As described in the previous embodiment, the first adhesive layer 136*a* may be formed of deposited silicon oxide, and the first ink-phobic material layer 136*b* may be formed of perfluorinated silane. The second nonwetting coating layer 137 includes a second adhesive layer 137*a*, which is formed on a top surface of the first ink-phobic material layer 136*b*, and a second ink-phobic material layer 137*b*, which is formed on a top surface of the second adhesive layer 137*a*. As described in the previous embodiment, the second adhesive layer 137*a* may be formed of deposited silicon oxide, and the second ink-phobic material layer 137*b* may be formed of perfluorinated silane.

Also, the third nonwetting coating layer 138 includes a third adhesive layer 138*a*, which is formed on a top surface of the second ink-phobic material layer 137*b*, and a third ink-phobic material layer 138*b*, which is formed on a top surface of the third adhesive layer 138*a*. The third adhesive layer 138*a* may be formed of deposited silicon oxide like the first and second adhesive layers 136*a* and 137*a*. The third adhesive layer 138*a* may be obtained by depositing silicon oxide on the top surface of the second ink-phobic material layer 137*b* using a PVD process. Also, the third ink-phobic material layer 138*b* may be formed of perfluorinated silane like the first and second ink-phobic material layers 136*b* and 137*b*. The third ink-phobic material layer 138*b* may be obtained by depositing perfluorinated silane on the top surface of the third adhesive layer 138*a* using a PVD process. In this case, a highly packed siloxane network may be generated at an interface between the third adhesive layer 138*a* and the third ink-phobic material layer 138*b*.

The surface roughness of outer surfaces of the third adhesive layer 138*a* and the third ink-phobic material layer 138*b* may be different, and roughness of the adjacent surfaces of the second adhesive layer 137*a* and the second ink-phobic material layer 137*b* may be same. That is, the roughness of the outer surface of the second ink-phobic material layer 137*b* may be smaller than the roughness of the outer surface of the second adhesive layer 137*a*. It is possible that the surface roughness of the outer surfaces of the second adhesive layer 137*a* and the second ink-phobic material layer 137*b* may be different from the surface roughness of outer surfaces of the first adhesive layer 136*a* and the first ink-phobic material layer 136*b*. It is also possible that the surface roughness of the outer surfaces of the second adhesive layer 137*a* and the second ink-phobic material layer 137*b* may be smaller than the surface roughness of outer surfaces of the first adhesive layer 136*a* and the first ink-phobic material layer 136*b*.

Thickness of the third adhesive layer 138*a* and the third ink-phobic material layer 138*b* may be different from each other. It is possible that the third adhesive layer 138*a* and the third ink-phobic material layer 138*b* may have the same thickness. It is also possible that the first adhesive layer 136*a* and the first ink-phobic material layer 136*b* may have a first thickness, the second adhesive layer 137*a* and the second ink-phobic material layer 137*b* may have a second thickness, and the third adhesive layer 138*a* and the third ink-phobic material layer 138*b* may have a third thickness. Each thickness may be different from one another. It is possible that each layer may have the same thickness.

Although it is described in the foregoing embodiments that two or three nonwetting coating layers formed on the surface of the nozzle plate 130, the present invention is not limited thereto and four or more nonwetting coating layers may be formed on the surface of the nozzle plate 130.

Hereinafter, when nonwetting coating layers formed on the surfaces of nozzle plates are formed of a single layer, a double layer, and a third layer, respectively, the results of an experiment on the three nonwetting coating layers will be described. In the present experiment, each of the nonwetting coating layers included an adhesive layer formed of deposited silicon oxide and an ink-phobic material layer formed of perfluorinated silane.

Figure 7A:
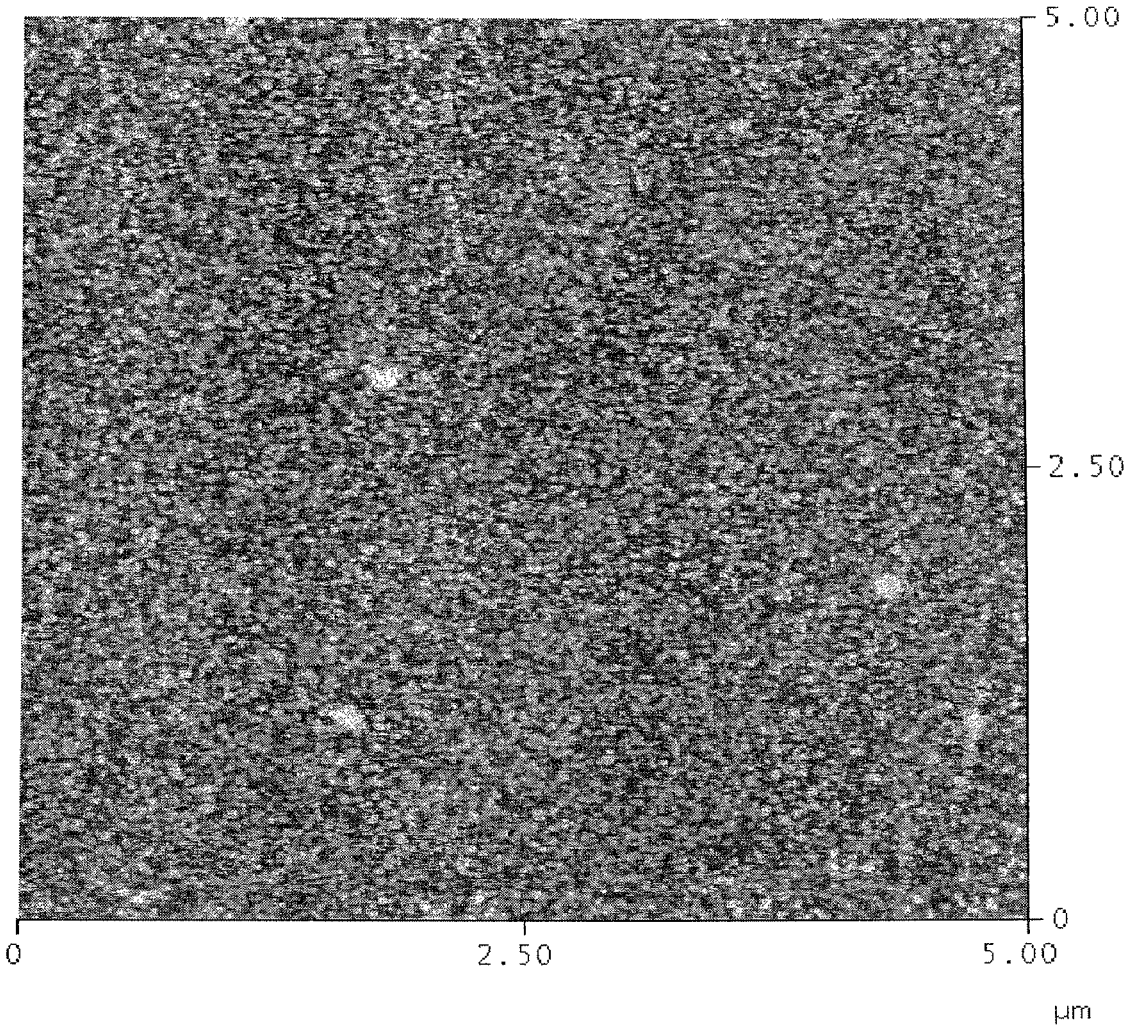
FIGS. 7A through 7C are atomic force microscopes (AFMs) of surfaces of nonwetting coating layers formed on surfaces of nozzle plates when the nonwetting coating layers are formed of a single layer, a double layer, and a triple layer, respectively.
Figure 7B:
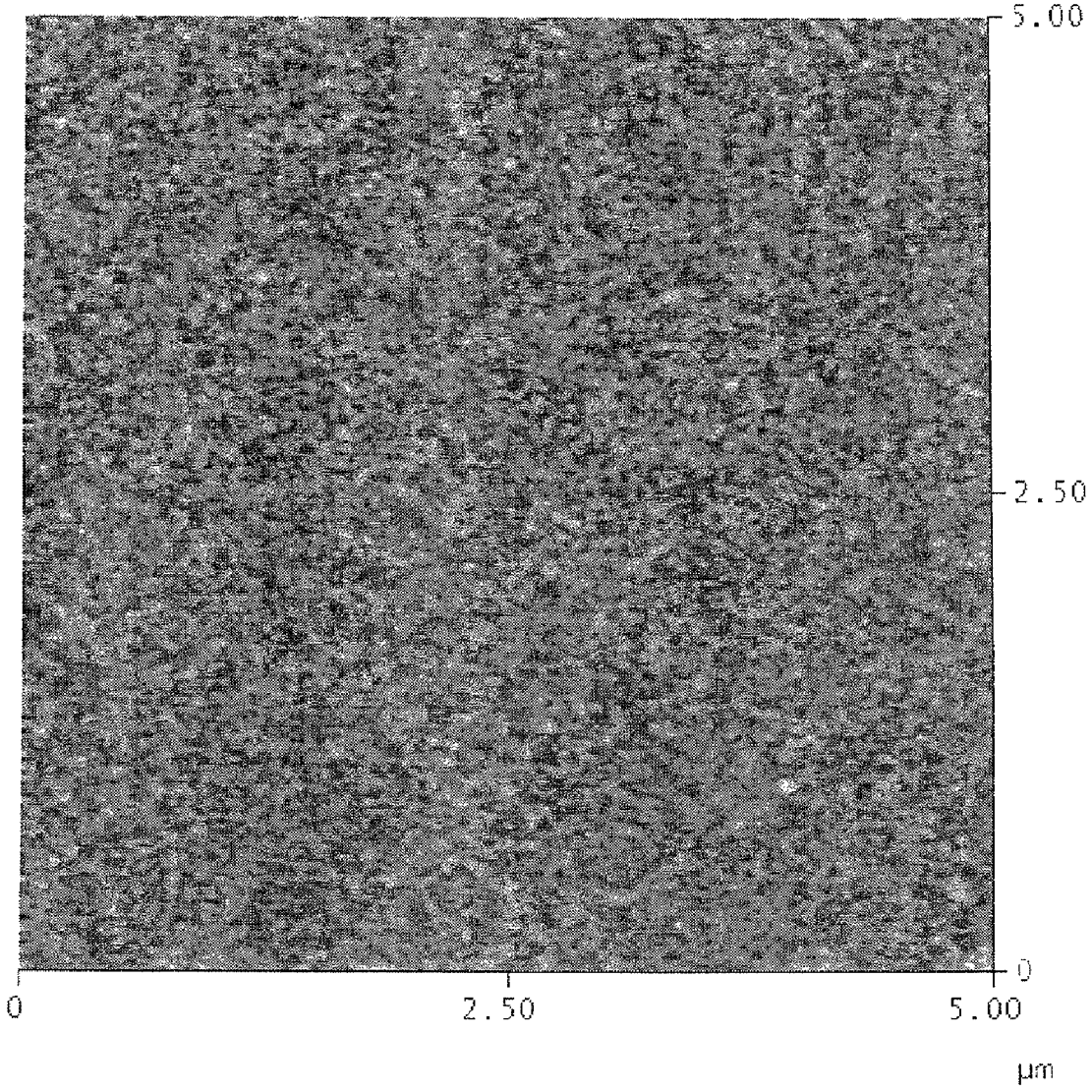
Figure 7C:
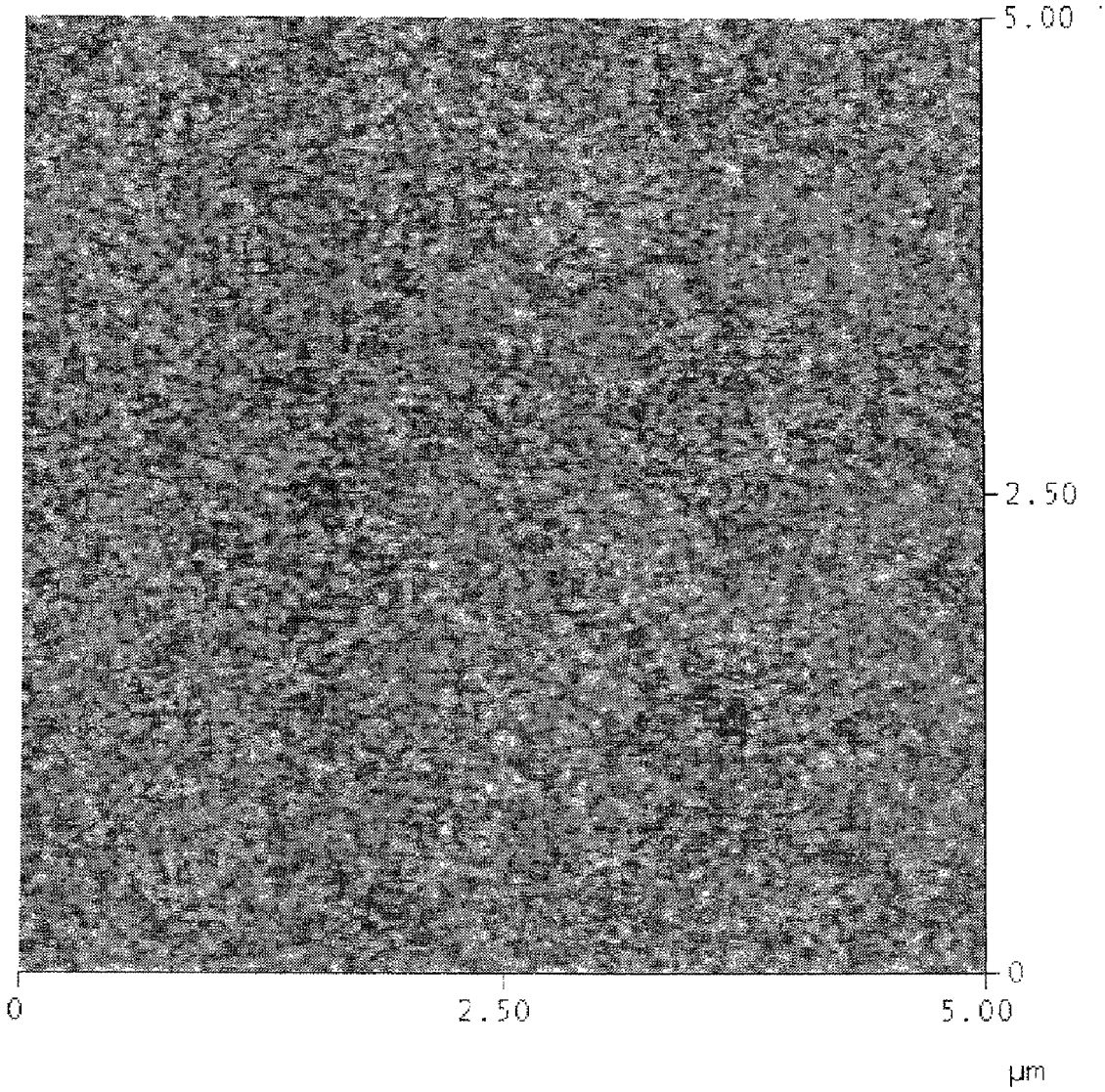

FIGS. 7A through 7C are atomic force microscopes (AFMS) of surfaces of nonwetting coating layers (more specifically, ink-phobic material layers) formed on surfaces of nozzle plates when the nonwetting coating layers are formed of a single layer, a double layer, and a triple layer, respectively.

Referring to FIGS. 7A through 7C, when the nonwetting coating layer is the single layer, the surface of the ink-phobic material layer has an RMS roughness of about 0.861 nm. When the nonwetting coating layer is the double layer, the surface of the ink-phobic material layer has an RMS roughness of about 0.354 nm. When the nonwetting coating layer is the triple layer, the surface of the ink-phobic material layer has an RMS roughness of about 0.433 nm. From this result, it can be seen that when the nonwetting coating layer is the double layer, the ink-phobic material layer has the lowest surface roughness.

Figure 8:
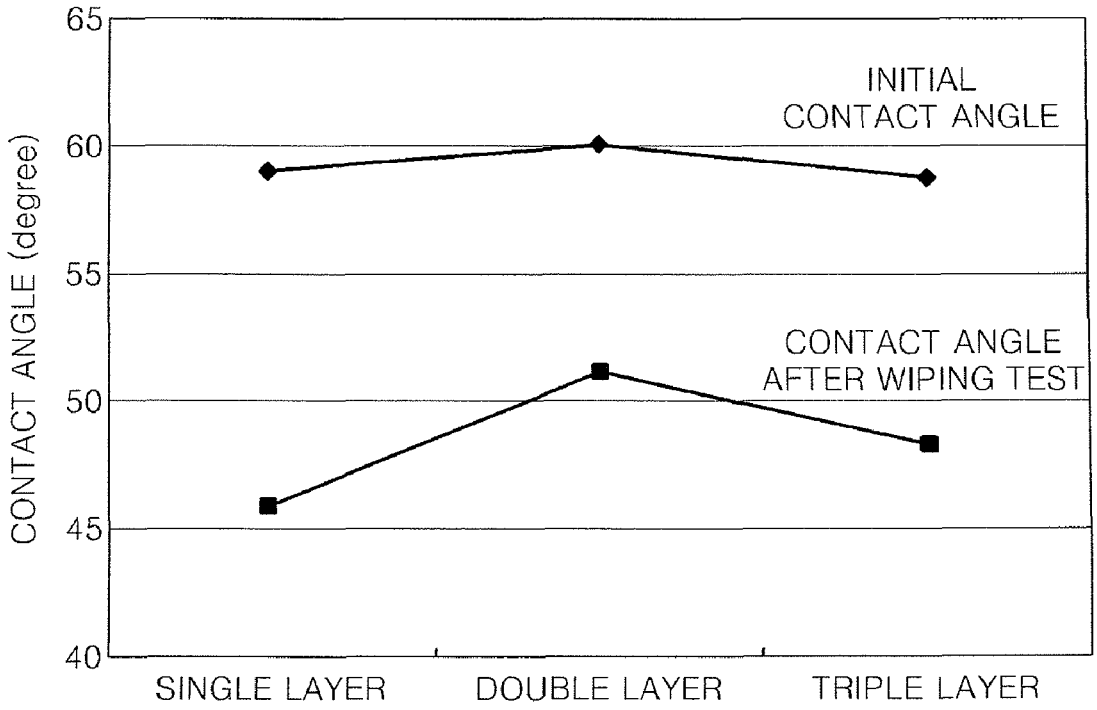
FIG. 8 is a graph of initial contact angles of nonwetting coating layers formed on surfaces of nozzle plates and contact angles of the nonwetting coating layers measured after conducting a wiping test on the nonwetting coating layers when the nonwetting coating layers are formed of a single layer, a double layer, and a triple layer, respectively.

FIG. 8 is a graph of initial contact angles of nonwetting coating layers (more specifically, ink-phobic material layers) formed on surfaces of nozzle plates and contact angles of the nonwetting coating layers (more specifically, the ink-phobic material layers) measured after conducting a wiping test on the nonwetting coating layers when the nonwetting coating layers are formed of a single layer, a double layer, and a triple layer, respectively. The wiping test is conducted on the surface of the ink-phobic material layers using a DiPropylene glycol Methyl ether Acetate (DPMA), which is an organic solvent. Also, the DPMA is used as a sessile drop for measuring the contact angles.

Referring to FIG. 8, the nonwetting coating layers formed of the single, double, and the triple layers have similar initial contact angles of about 60°. However, after conducting the wiping test, the nonwetting coating layer formed of the double layer has the largest contact angle, while the nonwetting coating layer formed of the single layer has the smallest contact angle. Thus, it can be concluded that when the nonwetting coating layer is the double layer, the nonwetting coating layer has the highest durability.

Figure 9:
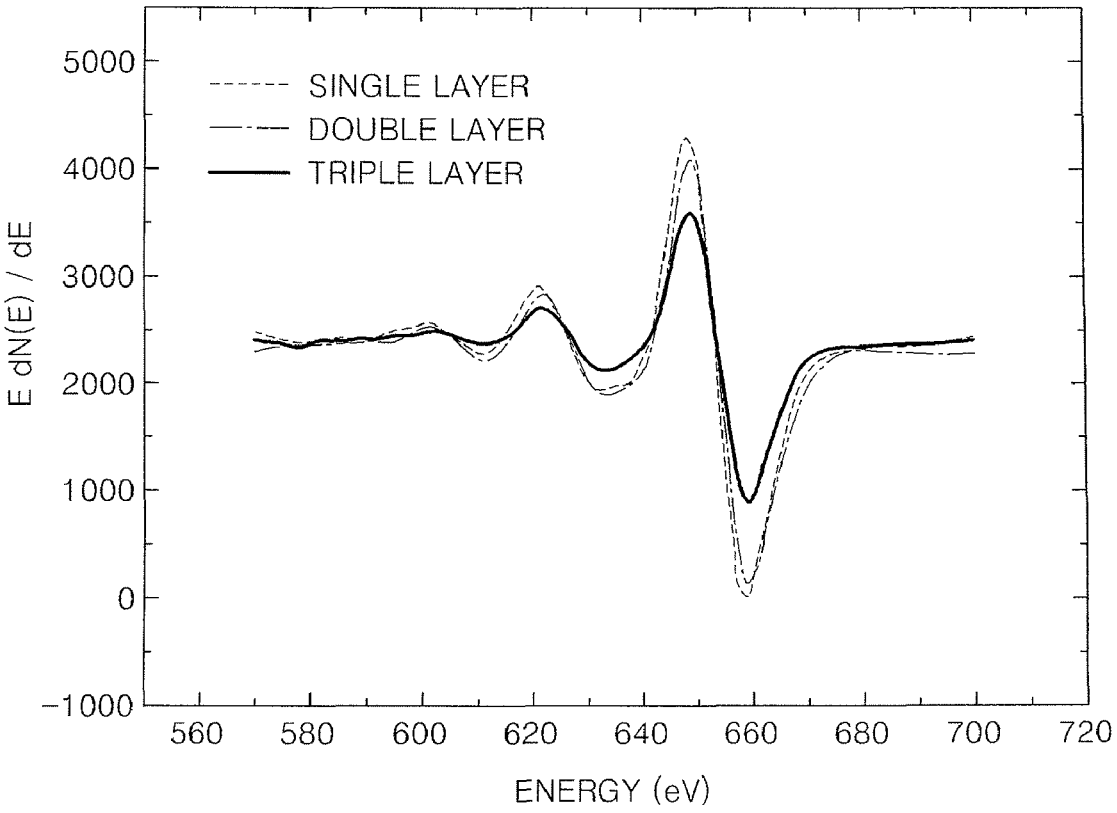
FIG. 9 shows Auger spectra obtained by the analysis of surfaces of nonwetting coating layers formed on surfaces of nozzle plates when the nonwetting coating layers are formed of a single layer, a double layer, and a triple layer, respectively.

FIG. 9 shows Auger spectra obtained by the analysis of surfaces of nonwetting coating layers (more specifically, ink-phobic material layers) formed on surfaces of nozzle plates when the nonwetting coating layers are formed of a single layer, a double layer, and a triple layer, respectively.

Referring to FIG. 9, it can be seen that when the nonwetting coating layers are formed of the single, double, and triple layers, respectively, the ink-phobic material layers are formed of almost the same amount of perfluorinated silane.

According to the present general inventive concept as described above, a plurality of nonwetting coating layers are disposed on the surface of a nozzle plate according to the present invention, and each of the nonwetting coating layers includes an adhesive layer and an ink-phobic material layer. Thus, the durability of the ink-phobic material layer can be greatly improved.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A nozzle plate usable with an inkjet printhead, the nozzle plate comprising:

a substrate through which a plurality of nozzles are formed;

an ink-philic material layer formed on an outer surface of the substrate and inner walls of the nozzles; and a plurality of nonwetting coating layers sequentially formed on the ink-philic material layer formed on the outer surface of the substrate, each nonwetting coating layer including an adhesive layer and an ink-phobic material layer deposited on the adhesive layer wherein each of the adhesive layer and ink-phobic material layer has a substantially uniform thickness and both of the adhesive layer and ink-phobic material layer totally cover the outer surface thereby each having holes coinciding with the nozzles.

2. The nozzle plate of claim 1, wherein the substrate is formed of silicon.

3. The nozzle plate of claim 2, wherein the ink-philic material layer is formed of thermally oxidized silicon.

4. The nozzle plate of claim 3, wherein the adhesive layer is formed of deposited silicon oxide.

5. The nozzle plate of claim 4, wherein the adhesive layer is formed using a physical vapor deposition (PVD) process.

6. The nozzle plate of claim 4, wherein the ink-phobic material layer is formed of perfluorinated silane.

7. The nozzle plate of claim 6, wherein the ink-phobic material layer is formed using a PVD process.

8. The nozzle plate of claim 1, wherein two nonwetting coating layers are formed on the ink-philic material layer formed on the outer surface of the substrate.

9. A method of forming a nozzle plate usable with an inkjet printhead, the method comprising:

forming a plurality of nozzles on a substrate;

forming an ink-philic material layer on an outer surface of the substrate and inner walls of the nozzles; and forming a plurality of nonwetting coating layers sequentially on the ink-philic material layer formed on the outer surface of the substrate, each nonwetting coating layer including an adhesive layer formed by coating and an ink-phobic material layer coated on the adhesive layer wherein each of the adhesive layer and ink-phobic material layer has a substantially uniform thickness and both of the adhesive layer and ink-phobic material layer totally cover the outer surface thereby each having holes coinciding with the nozzles.

10. A nozzle plate usable with an inkjet printhead, the nozzle plate comprising:

a substrate having a nozzle;

an ink-philic material layer formed on an outer surface of the substrate and an inner wall of the nozzle;

a first adhesive layer formed on the ink-philic material layer;

a first ink-phobic material layer formed on the first adhesive layer;

a second adhesive layer formed on the first ink-phobic material layer; and a second ink-phobic material layer formed on the second adhesive layer.

11. The nozzle plate of claim 10, wherein the first adhesive layer has a first thickness, and each of the first and second ink-phobic material layers has a second thickness.

12. The nozzle plate of claim 11, wherein the first adhesive layer has surface having a first surface roughness, and each of the first and second ink-phobic material layers has a second surface roughness.

13. The nozzle plate of claim 10, wherein the second adhesive layer has a first thickness, and each of the first and second ink-phobic material layers has a second thickness.

14. The nozzle plate of claim 13, wherein the second adhesive layer has a surface having a first surface roughness, and each of the first and second ink-phobic material layers has a second surface having a second surface roughness.

15. The nozzle plate of claim 10, wherein the first and second ink-phobic material layers have different surface roughness than each other.

16. The nozzle plate of claim 10, wherein the first and second ink-phobic material layers have a same thickness as each other.

17. The nozzle plate of claim 10, wherein the first and second ink-phobic material layers comprises a first ink-phobic material layer having a first thickness and a second ink-phobic material layer having a second thickness.

18. The nozzle plate of claim 10, wherein the first and second ink-phobic material layers comprises a first ink-phobic material layer having a first surface roughness and a second ink-phobic material layer having a second surface roughness.

19. An inkjet printhead, comprising:

a layer formed with a pressure chamber to contain ink; and a nozzle plate having a substrate through which a nozzle is formed to eject the ink from the pressure chamber, an ink-philic material layer formed on an outer surface of the substrate and an inner wall of the nozzle, and a plurality of nonwetting coating layers sequentially formed on the ink-philic material layer formed on the outer surface of the substrate, each nonwetting coating layer including an adhesive layer and an ink-phobic material layer deposited on the adhesive layer, wherein each of the adhesive layer and ink-phobic material layer has a substantially uniform thickness and both of the adhesive layer and ink-phobic material layer totally cover the outer surface thereby each having holes coinciding with the nozzles.

* * * * *